US005884803A

United States Patent [19]

Vine

[11] Patent Number: 5,884,803

[45] Date of Patent: Mar. 23, 1999

[54] DISPENSER FOR DISPOSABLE CUPS

[76] Inventor: Menachem Vine, 8 Basht Street, Telz Stone, D.N. Harei Yehuda 90838, Israel

[21] Appl. No.: 749,208

[22] Filed: Nov. 14, 1996

[30] Foreign Application Priority Data

Dec. 29, 1995 [IL] Israel ..... 116613

[51] Int. Cl.[6] ..... A47K 10/24

[52] U.S. Cl. ..... 221/44; 221/283; 221/63; 221/45; 312/43

[58] Field of Search ..... 221/221, 283, 221/353, 63, 44, 45, 46, 310; 312/43; 248/225.11

[56] References Cited

U.S. PATENT DOCUMENTS

| | | | |
|---|---|---|---|
| Re. 17,644 | 5/1930 | Barbieri | 221/45 |
| 1,935,600 | 11/1933 | Wolf | 221/283 |
| 2,068,908 | 1/1937 | Conti | 221/63 |
| 2,141,682 | 12/1938 | Carew | 221/63 |
| 3,069,048 | 12/1962 | Easton et al. | 221/63 |
| 3,389,883 | 6/1968 | Johnson | 248/225.11 |
| 3,623,636 | 11/1971 | D'Ercoli et al. | 221/63 |
| 3,977,801 | 8/1976 | Murphy | 248/225.11 |
| 4,951,837 | 8/1990 | Lentsch | 221/45 |
| 5,427,273 | 6/1995 | Vine . | |

FOREIGN PATENT DOCUMENTS

| | | | |
|---|---|---|---|
| 1373245 | 8/1964 | France | 248/225.11 |

*Primary Examiner*—H. Grant Skaggs
*Attorney, Agent, or Firm*—Pollock, Vande Sande & Amernick

[57] ABSTRACT

The invention provides a cup dispenser for sequentially dispensing a stacked column of disposable cups, including a mounting plate provided with means for attaching the dispenser to a vertical surface, a cup-retaining and dispensing body attachable thereto and suspendable therefrom, the body being provided with an annular opening having a lower edge and with retaining means consisting essentially of at least two wedge-like protrusions extending from the inner walls thereof and positioned within a same imaginary first semi-annular, co-planar segment of the opening, the wedge-like protrusions each having an apex, an inside face and a base, wherein the bases face the lower edge and the protrusions taper into the opening from the respective apexes to the respective bases along the inside face, and wherein at least one inner wall segment of the opening, positioned between the protrusions within the same imaginary semi-annular, co-planar segment of the opening, is provided with a recess to facilitate the local outward expansion of the rim of a downwardly-extending cup to be dispensed during removal thereof from the dispenser; and a third protrusion, positioned in a second imaginary, semi-annular, co-planar segment of the opening, opposite the first semi-annular, co-planar segment of the opening; whereby the retaining means provide rim support for the retention of each sequential cup to be dispensed until removal thereof from the dispenser.

10 Claims, 2 Drawing Sheets

DISPENSER FOR DISPOSABLE CUPS

BACKGROUND OF THE INVENTION

1. Field of the Invention

The present invention relates to a dispenser for disposable cups. More particularly, the invention provides an improved dispenser which is able to dispense tapered, deformable cups of varying capacity, and which holds a stacked column of cups in a convenient position for removal, when required, of the lowest cup.

2. Description of the Prior Art

Users of water coolers, water purifiers and dispensing devices for hot or cold drinks often use disposable, tapered plastic cups. Hot drinks are usually dispensed in thick, foamed-plastic cups, whereas cups made of a thin, solid plastic and having a rim are suitable for cold beverages. Particularly when drinks are provided in offices or in public buildings, the cost of these disposable cups is justified by the saving of cup washing facilities, and in the improved hygiene inherent in providing each user with a new cup.

Tapered cups, of the types described above, can conveniently be stacked in a column to save space, and placed near a water cooler or drink dispenser. The stacked column of cups makes possible the use of a cup dispenser, wherein the cups are protected from dirt and dispersal. Such dispensers may be attached to any vertical surface, and are often directly attached to the water cooler or drink dispenser.

A known cup dispenser comprises a long, tubular housing suspended near its upper opening by a bracket and attached by said bracket to a water cooler or drink dispenser. The lowest cup, which is the first cup to be used, is often inconveniently positioned at a height which requires the user to stoop down in order to remove it from the dispenser.

The dispenser described in Applicant's prior U.S. Pat. No. 5,427,273, corresponding to Israel Specification 106,374, is suitable for holding a small range of cup sizes, for example, those having rim diameters in the range of between 69–75 mm. Such a dispenser does not retain cups having a rim diameter of about 63 mm. Conversely, a dispenser dimensioned for the smaller size cups will not allow passage of larger sized cups. In order to be able to dispense both smaller and larger cups, it would therefore be necessary to manufacture and market at least two different sized dispensers.

It is therefore an object of the present invention to provide a cup dispenser which is large enough to dispense both the larger cups having a rim diameter of between 69–75 mm, yet also retains and dispenses smaller cups having a rim diameter of between 63–68 mm.

SUMMARY OF THE INVENTION

The present invention achieves the above objectives by providing a cup dispenser for sequentially dispensing a stacked column of disposable cups, comprising a mounting plate provided with means for attaching said dispenser to a vertical surface; a cup-retaining and dispensing body attachable thereto and suspendable therefrom, said body being provided with an annular opening having a lower edge and with retaining means consisting essentially of at least two wedge-like protrusions extending from the inner walls thereof and positioned within a same imaginary first semi-annular, co-planar segment of said opening; said wedge-like protrusions each having an apex, an inside face and a base, wherein said bases face said lower edge and said protrusions taper into said opening from said respective apexes to said respective bases along said inside face, and wherein at least one inner wall segment of said opening, positioned between said protrusions within the same imaginary semi-annular, co-planar segment of said opening, is provided with a recess to facilitate the local outward expansion of the rim of a downwardly-extending cup to be dispensed during removal thereof from said dispenser; and a third protrusion, positioned in a second imaginary, semi-annular, co-planar segment of said opening, opposite said first semi-annular, co-planar segment of said opening; whereby said retaining means provide rim support for the retention of each sequential cup to be dispensed until removal thereof from said dispenser.

In a preferred embodiment of the present invention, there is provided a dispenser for disposable cups, wherein one of said protrusions positioned within said imaginary first semi-annular, co-planar segment, and said third protrusion, are mutually spaced apart by an angle of between 30°–69°, said dispenser being able to retain cups having a rim diameter in the range of from about 63–75 mm.

In a most preferred embodiment of the present invention, there is provided a dispenser for disposable cups wherein said protrusions extend inwards sufficiently to alone support cup rims having a diameter in the range of from about 63–75 mm.

Further embodiments of the invention will be described below.

As a result of the positioning of the protrusions, which will be described below, removal of the lowest cup in the stack is an easy action. The user grasps the cup and rocks the cup side to side to achieve its removal, needing to apply no more downward force than the weight of his hand.

The invention will now be described in connection with certain preferred embodiments, with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
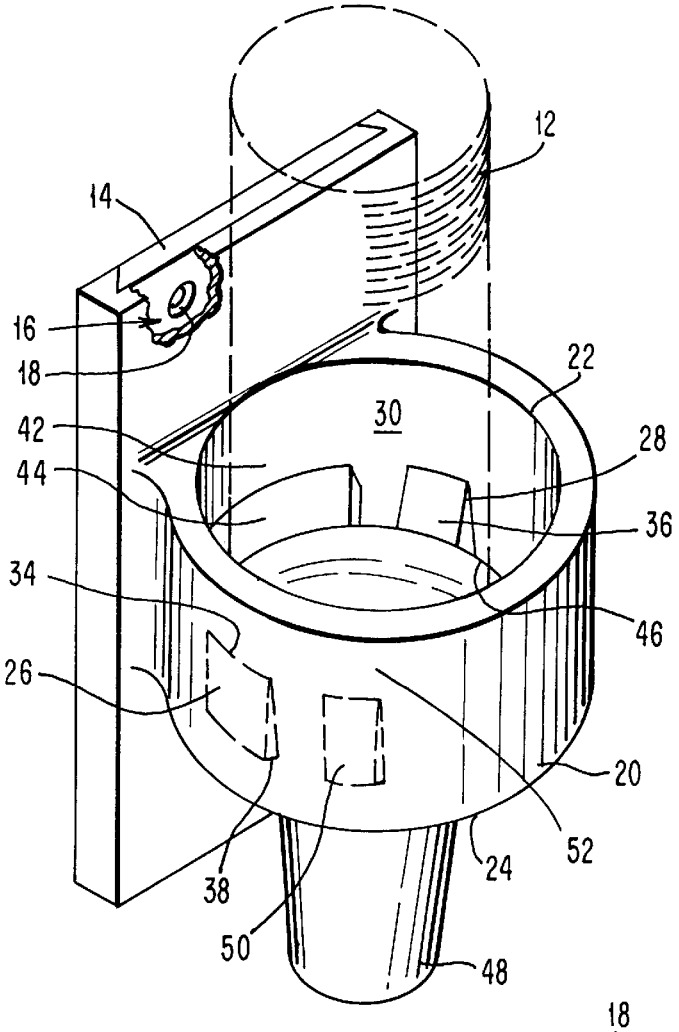
FIG. 1 is a perspective view of a preferred embodiment of the cup dispenser according to the invention.

There is seen in FIG. 1 a cup dispenser 10 for sequentially dispensing a stacked column of disposable cups 12, shown in light dashed lines. A mounting plate 14 is provided with means 16, shown here as one of a plurality of screw holes 18, for attachment of cup dispenser 10 to a vertical surface. A cup-retaining body 20 is attachable to and suspendable from cup dispenser 10 by means of screws inserted through said screw holes, or with double-sided tape (not shown).

Body 20 can be suitably cast or molded from any one of many different materials, including ABS with or without plating, an acetal copolymer, glass-reinforced nylon, zinc-aluminum alloy suitable for diecasting, or a platable grade of polypropylene.

Body 20 is provided with an annular opening 22 having a lower edge 24. Two wedge-like protrusions 26, 28 extend from the inner walls 30 of body 20 and are positioned within the same imaginary first semi-annular, co-planar segment 32 of opening 22, as better seen in FIG. 2.

In other words, protrusions 26, 28 are not precisely opposite each other. This provides an advantage in facilitating the withdrawal of the lowest cup from the dispenser by simply rocking the cup back and forth to release it from one protrusion and then from the other, without the need to exert a pulling force thereon.

The wedge-like protrusions 26, 28 each have an apex 34, an inside face 36 and a base 38. The bases 38 face the opening lower edge 24, and the wedge-like protrusions 26, 28 taper into opening 22 from their respective apexes 34 to their respective bases 38 along the inside face 36. Preferably, the slope gradient of protrusions 26 and 28 is such that it enables the engagement of cups having rims with diameters between 69–75 mm. An angle of 18° on each protrusion has been found to be suitable.

At least one inner wall segment 42 of opening 22, positioned between protrusions 26, 28 within the same imaginary semi-annular, co-planar segment 32, is provided with a recess 44 which facilitates the local outward expansion of the rim 46 of a downwardly-extending cup 48 to be dispensed during removal thereof from the dispenser 10. Such expansion is caused by distortion of the cup, either as the hand of the user grips the cup 48, or as the cup 48 is pulled downwards and/or sideways and its rim 46 is pressed inwards by protrusions 26, 28.

Figure 2:
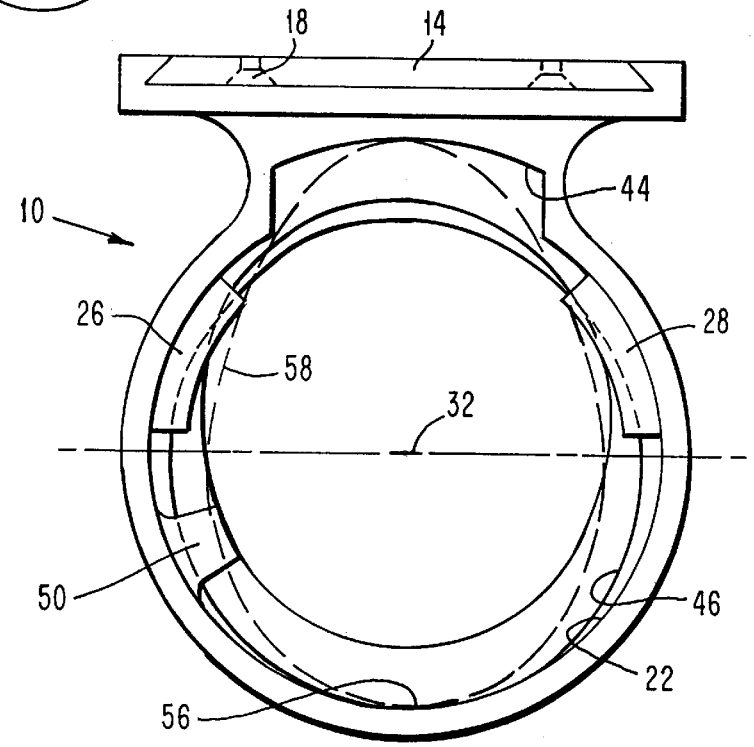
FIG. 2 is a plan view of the embodiment of FIG. 1, holding a cup having a rim diameter of about 75 mm and showing more clearly the preferred positions of the protrusions.
Figure 3:
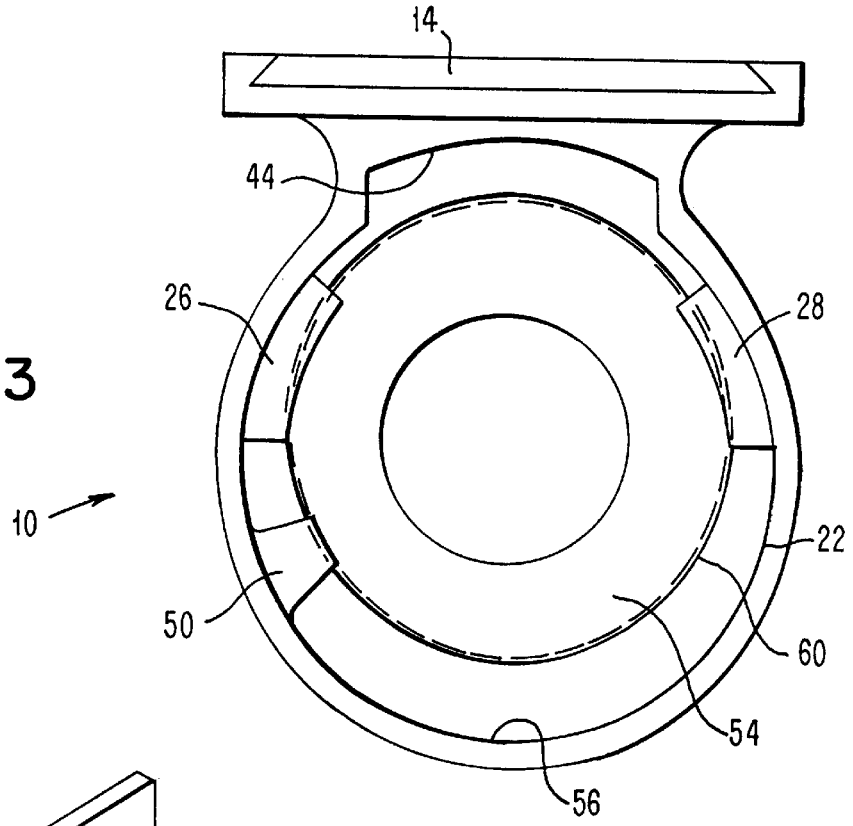
FIG. 3 is the same as the plan view of FIG. 2, illustrating the dispenser holding a small cup with a rim diameter of about 63 mm.

A third protrusion 50 is positioned in a second imaginary, semi-annular, co-planar segment 52 of opening 22, opposite the first semi-annular, co-planar segment 32. The third protrusion 50, seen more clearly in FIG. 2, is positioned about 50° from protrusion 26. Such a location will not unduly hinder the passage of a large cup rim 46, as said rim is in any case distorted inwards during its passage past protrusion 26. At the same time, the third protrusion 50 is adequate to ensure the retention of smaller-sized cups 54, as shown in FIG. 3. Thus, protrusions 26, 28, and in the case of a smaller cup, also protrusion 50, provide the necessary rim support for the retention of each sequential cup 48 to be dispensed, until removal thereof from the dispenser 10.

FIG. 2 more clearly depicts the preferred positions of the protrusions 26, 28, 50, in the embodiment described above with reference to FIG. 1. Protrusions 26, 28 are suitably spaced apart by an angle of between 120°–169°. Protrusion 26 and protrusion 50 are mutually spaced apart by an angle of between 30°–69°, preferably 45°–55°.

Dispenser 10 is thus able to retain cups 48, 54 having a rim diameter in the range from about 63–75 mm.

A part of wall 56 of annular opening 22, substantially diametrically opposite rim expansion recess 44, provides support for cup rims 46 having a diameter exceeding about 69 mm. Dashed line 58 indicates a cup rim 46 which is temporarily distorted inwards during its passage over and in proximity to protrusions 26, 28, recess 44 accommodating the resulting outward expansion of rim 46.

FIG. 3 again illustrates dispenser 10, here shown holding a small cup 54 having a rim diameter of about 63 mm. As shown, protrusions 26, 28, 50 extend inwards sufficiently to alone support the rims 60 of small cups having a diameter in the range of 63–68 mm. Small cup 54 does not contact the inner wall 56 of the dispenser opening 22. The third protrusion 50 thus serves to maintain contact between the small cup rim 60 and protrusions 26, 28 by urging said cup back towards said protrusions 26, 28 to be supported thereby in conjunction with the support provided by protrusion 50. As has been explained above, the third protrusion 50, being positioned quite close to protrusion 26, does not unduly hinder the passage of the rim 46 of a large cup (shown in FIG. 2), as rim 46 is in any case locally distorted inwards during its passage past protrusion 26.

Figure 4:
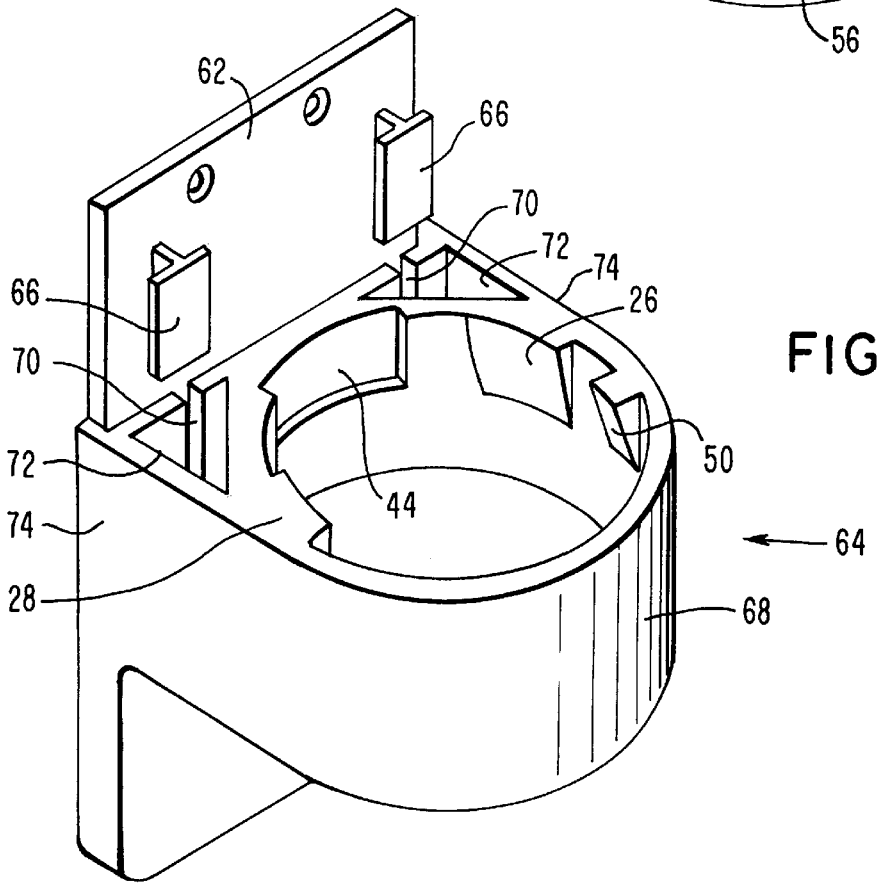
FIG. 4 is a perspective view of another embodiment of the dispenser of the invention, seen upside down and with a partially assembled mounting plate.

FIG. 4 shows an embodiment of a dispenser 64, illustrated upside down and with its mounting plate 62 partially assembled. In this embodiment, the mounting plate 62 is provided with T-shaped section projections 66, and body 68 has corresponding recesses 69 for said projections 66. After body 68 is assembled over mounting plate 62, the mounting plate is substantially hidden from view. This is aesthetically advantageous and also serves to discourage the unauthorized removal of dispenser 64.

In the embodiment of FIG. 4, recesses 69 form a part of hollows 72 in a plastic molding, which serve to reduce the wall thickness for molding purposes. Excessive wall thickness between sides 75 of the mounting plate area and the generally cylindrical body 68 must be reduced, not only to save material, but also to avoid deep sink marks and for reducing molding time. The embodiment of FIG. 4 shows the utilization of these hollows for attachment of the dispenser to a vertical surface.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cup dispenser for sequentially dispensing a stacked column of disposable cups, comprising:

a mounting plate provided with means for attaching said dispenser to a vertical surface;

a cup-retaining and dispensing body attachable thereto and suspendable therefrom, said body being provided with an annular opening having a lower edge and with retaining means consisting essentially of at least two wedge-like protrusions extending from the inner walls thereof and positioned within a same imaginary first semi-annular, co-planar segment of said opening;

said wedge-like protrusions each having an apex, an inside face and a base, wherein said bases face said lower edge and said protrusions taper into said opening from said respective apexes to said respective bases along said inside face, and wherein an inner wall segment of said opening, positioned between said two protrusions within the same imaginary semi-annular, co-planar segment of said opening, is provided with a recess to facilitate the temporary local outward expansion of the rim of a downwardly-extending cup to be dispensed during removal thereof from said dispenser; and a third protrusion, positioned in a second imaginary, semi-annular, co-planar segment of said opening, opposite said first semi-annular, co-planar segment of said opening, wherein the cup dispenser includes only three protrusions;

whereby said retaining means provide rim support for the retention of each sequential cup to be dispensed until removal thereof from said dispenser.

2. The dispenser as claimed in claim 1, wherein one of said protrusions positioned within said imaginary first semi-annular, co-planar segment, and said third protrusion, are mutually spaced apart by an angle of between 30°–69°, said dispenser being able to retain cups having a rim diameter in the range of from about 63–75 mm.

3. The dispenser as claimed in claim 2, wherein said angle is between 45°–55°.

4. The dispenser as claimed in claim 1, wherein said two protrusions in said imaginary first, semi-annular, co-planar segment are mutually spaced apart by an angle of between 120°–169°.

5. The dispenser as claimed in claim 1, wherein a part of the wall of said annular opening substantially diametrically opposite said rim expansion recess provides support for cup rims having a diameter exceeding about 69 mm.

6. The dispenser as claimed in claim 1, wherein said protrusions extend inwards sufficiently to alone support cup rims having a diameter in the range of from about 63–75 mm.

7. The dispenser as claimed in claim 1, wherein said mounting plate is provided with T-shaped section projections, and said body is provided with corresponding recesses for same, said mounting plate being substantially hidden from view after the assembly thereover of said body.

8. The dispenser as claimed in claim 7, wherein said corresponding recesses form a part of hollows in a plastic molding, serving to reduce wall thickness for molding purposes.

9. A cup dispenser for sequentially dispensing a stacked column of disposable cups, comprising:

a mounting plate including means for attaching the dispenser to a vertical surface;

a cup-retaining and dispensing body attachable to the mounting plate and suspendable therefrom, the body including an inner wall and an annular opening having a lower edge;

a first wedge-like protrusion and a second wedge-like protrusion extending from the inner wall of the body and terminating within a first semi-annular segment of the opening, the first and second wedge-like protrusions each having an apex, an inside face and a base, wherein the bases face the lower edge of the body and taper into the opening from the respective apex to the respective base along the inside face;

a recess provided in an inner wall segment of the opening of the body, the recess being positioned between the first and second wedge-like protrusions within the first semi-annular segment of the opening, the recess facilitating a temporary local outward expansion of a rim of a downwardly-extending cup to be dispensed during removal of the cup from the dispenser; and a third wedge-like protrusion extending from the inner wall of the body and terminating within a second semi-annular segment of the opening opposite the first semi-annular segment of the opening, the third wedge-like protrusion having an apex, an inside face and a base, wherein the base faces the lower edge of the body and tapers into the opening from the respective apex to the respective base along the inside face, the third wedge-like protrusion extending into the opening a greater length than the first or second wedge-like protrusion;

wherein the first, second, and third wedge-like protrusions are arranged asymmetrically about the inner wall of the body, and whereby the first, second, and third wedge-like protrusions provide rim support for the retention of each sequential cup to be dispensed until removal of the cup from the dispenser, and whereby the cups may have different diameters.

10. A cup dispenser for sequentially dispensing a stacked column of disposable cups, comprising:

a mounting plate including means for attaching the dispenser to a vertical surface;

a cup-retaining and dispensing body attachable to the mounting plate and suspendable therefrom, the body including an inner wall and an annular opening having a lower edge;

a first wedge-like protrusion and a second wedge-like protrusion extending from the inner wall of the body and terminating within a first semi-annular segment of the opening, the first and second wedge-like protrusions each having an apex, an inside face and a base, wherein the bases face the lower edge of the body and taper into the opening from the respective apex to the respective base along the inside face;

a recess provided in an inner wall segment of the opening of the body, the recess being positioned between the first and second wedge-like protrusions within the first semi-annular segment of the opening, the recess facilitating a temporary local outward expansion of a rim of a downwardly-extending cup to be dispensed during removal of the cup from the dispenser; and a third wedge-like protrusion extending from the inner wall of the body and terminating within a second semi-annular segment of the opening opposite the first semi-annular segment of the opening, the third wedge-like protrusion having an apex, an inside face and a base, wherein the base faces the lower edge of the body and tapers into the opening from the respective apex to the respective base along the inside face;

wherein a distance between each pair of adjacent protrusions is different, and whereby the first, second, and third wedge-like protrusions provide rim support for the retention of each sequential cup to be dispensed until removal of the cup from the dispenser, and whereby the cups may have different diameters.

* * * * *